US008410982B2

(12) United States Patent
Yung et al.

(10) Patent No.: US 8,410,982 B2
(45) Date of Patent: Apr. 2, 2013

(54) UNIDIRECTIONAL ANTENNA COMPRISING A DIPOLE AND A LOOP

(75) Inventors: Edward Kai Ning Yung, Hong Kong (CN); Pak Wai Chan, Kowloon (CN); Hang Wong, Hong Kong (CN)

(73) Assignee: City University of Hong Kong, Hong Kong (CN)

( * ) Notice: Subject to any disclaimer, the term of this patent is extended or adjusted under 35 U.S.C. 154(b) by 43 days.

(21) Appl. No.: 12/257,111

(22) Filed: Oct. 23, 2008

(65) Prior Publication Data

US 2010/0103061 A1 Apr. 29, 2010

(51) Int. Cl.
*H01Q 1/38* (2006.01)
*H01Q 21/00* (2006.01)
*H01Q 7/00* (2006.01)

(52) U.S. Cl. ..... 343/700 MS; 343/886; 343/793; 343/728; 343/730

(58) Field of Classification Search ..... 343/700 MS, 343/702, 741, 866, 907, 725–728, 793, 802
See application file for complete search history.

(56) References Cited

U.S. PATENT DOCUMENTS

| | | | | |
|---|---|---|---|---|
| 6,452,549 | B1 * | 9/2002 | Lo | 343/700 MS |
| 6,600,450 | B1 * | 7/2003 | Efanov et al. | 343/726 |
| 7,408,517 | B1 * | 8/2008 | Poilasne et al. | 343/742 |
| 7,589,686 | B2 * | 9/2009 | Balzovsky et al. | 343/726 |
| 7,639,201 | B2 * | 12/2009 | Marklein et al. | 343/866 |
| 7,760,150 | B2 * | 7/2010 | Sato | 343/724 |
| 2007/0120756 | A1 * | 5/2007 | Ogino et al. | 343/713 |
| 2007/0152891 | A1 * | 7/2007 | Fabrega-Sanchez et al. | 343/702 |
| 2008/0136720 | A1 * | 6/2008 | Parsche et al. | 343/741 |
| 2009/0033558 | A1 * | 2/2009 | Chung | 343/700 MS |

FOREIGN PATENT DOCUMENTS

WO WO 2006/068419 * 12/2005

OTHER PUBLICATIONS

Wong, K.L. and Yang, K.P.: "Modified planar inverted F antenna," *Electron. Lett.*, 1998, 34, (1), pp. 7-8.
Zhang, L.N., Zhong, S.S., Liang, X.L., Li, C.H.: "Compact meander monopole antenna for tri-band WLAN application," *Microwave Opt. Technol. Lett.*, 2007, 49, (4), pp. 986-988.
Peng, C.M., Chen, I.F., Yeh, J.J. and Hsue, C.W.: "Printed modified loop antenna for WLAN/WiMAX applications," *Electron. Lett.*, 2007, 43, (5), pp. 11-12.
Huynh, M.C. and Stutzman, W.: "Ground plane effects on planar inverted-F antenna (PIFA) performance," *IEE Proc. Microwaves, Antennas Propag.*, 2003, 150, (4), pp. 209-213.
Ávila-Navarro, E., Carrasco, J.A., Reig, C.: "Design of Yagi-like printed antennas for WLAN applications," *Microwave Opt. Technol. Lett*, 2007, 49, (9), pp. 2174-2178.
Lin, C.C., Su, C.M., Hsiao, F.R., Wong, K.L.: "Printed folded dipole array antenna with directional radiation for 2.4/5 GHz WLAN operation," *Electron. Lett.*, 2003, 39, (24), pp. 1698-1699.
Clavin, A.: "A new antenna feed having equal E-and H-plane patterns," *Antennas Propaga., Trans. of the IRE Professional Group*, 1954, 2, (3), pp. 113-119.
Clavin, A.: "A multimode antenna having equal E-and H-plane," *IEEE Trans. Antennas Propaga.*, 1975, AP-23, (5), pp. 735-737.
Luk, K.M. and Wong, H.: "A new wideband unidirectional antenna element," *Int. Journal of Microwave and Opt. Techno.*, 2006, 1, (1), pp. 35-44.

* cited by examiner

*Primary Examiner* — Trinh Dinh
(74) *Attorney, Agent, or Firm* — Heslin Rothenberg Farley & Mesiti P.C.

(57) ABSTRACT

A unidirectional wireless antenna with a front-to-back ratio of 20 dB comprises a loop antenna and a dipole antenna interconnected by a metallic element and printed on a printed circuit board. The antenna is small in size but provides good unidirectional transmission.

13 Claims, 3 Drawing Sheets a)

b)

Measure co-planar
Measure cross-planar
Simulated co-planar
Simulated cross-planar

UNIDIRECTIONAL ANTENNA COMPRISING A DIPOLE AND A LOOP

BACKGROUND OF THE INVENTION

Technical Field

This invention relates generally to wireless communications, and more particularly to a printed unidirectional antenna for use in wireless communications.

An antenna is an important element in a wireless communication device. Examples of a wireless communication device include a cellular phone, personal digital assistant and a wireless controller. The antenna in a wireless communication device serves as an aerial interface for transmitting and receiving radio frequency waves.

For the radiation patterns used in the wireless communications, omni-directional like antennas are very popular in small device applications as these antenna can be used in any orientation with respect to the radiating source. However, for some applications that require the wireless device to have a directional pattern such as home wireless audio where the transmission between speakers and the transceiver must be directed, and some handheld device that desire to radiate in a particular direction, a conventional printed small antenna may not be a good choice for fulfilling such requirement. While there are some designs for a directional printed antenna, some of these designs use a large ground plane placed below the antenna element, while others place a reflector in the printed surface for providing a directional pattern. However, placing a large ground plane and reflector in the antenna element results in enlarging the antenna and therefore such solutions are cost ineffective for small wireless device implementation.

The concept of a complementary antenna consisting of an electric dipole and a magnetic dipole is known. It is also known that an electric dipole has a radiation pattern of figure-'8' in the E-plane and a radiation pattern as a circle in the H-plane; while a magnetic dipole has a radiation pattern of nearly circular in the E-plane and a radiation pattern of figure-'8' in the H-plane. When both electric and magnetic dipoles are excited simultaneously with appropriate amplitude and phase, a directional radiation and identical E and H planes can be realized by the superposition of these two radiating sources. However, prior complementary antennas have been too large for implementing into small directional devices.

SUMMARY OF THE INVENTION

According to the present invention there is provided a unidirectional antenna for transmitting and/or receiving radio frequency waves, the antenna comprising a dipole antenna element and a loop antenna element coupled by a metallic transition element, wherein the loop antenna element is arranged to have a total length of substantially one wavelength of the radio frequency waves, thereby forming an integrated antenna arranged to generate a common radiation pattern having a dominant propagation wave front along one axis, the metallic transition element being arranged to join a first portion of the dipole antenna element and a second portion of the dipole antenna element to define a first and second junction adjacent to a center top portion of the loop antenna element with a width of the metallic transition element being less than the width of the loop antenna element, and wherein the dipole antenna element, the loop antenna element and the metallic transition element are formed on a substrate.

In preferred embodiments of the invention such an antenna generates a unidirectional radiation pattern with front-to-back ratio of 20 dB.

The dipole antenna may be a fat dipole, while the loop antenna may be a rectangular loop antenna, or a circular or square loop antenna.

Preferably no ground plane is provided, and the dipole antenna and the loop antenna are formed on a printed circuit board. Preferably end of the loop antenna is connected to an SMA connector and the other end of the loop antenna is connected to ground. The antenna may be fed without a balun.

BRIEF DESCRIPTION OF THE DRAWINGS

The present invention will now be described by way of example and with reference to the accompanying drawings, in which.

DETAILED DESCRIPTION OF THE PREFERRED EMBODIMENTS

The following detailed description with reference to the appended drawings is intended as a description of examples of the currently preferred embodiments of the present invention, and is not intended to represent the only form in which the present invention may be practiced. It is to be understood that the same or equivalent functions may be accomplished by different embodiments that are intended to be encompassed within the spirit and scope of the present invention.

In one example of the present invention, a printed dipole antenna connecting with a loop antenna is provided for transmitting and receiving radio frequency waves. In the example of the present invention described below, a unidirectional antenna includes two antenna elements on one single printed layer. The design comprises a rectangular loop antenna, which has magnetic dipole characteristics, and a dipole antenna, which has electric dipole characteristics, with the dipole antenna and the loop antenna being connected by a metallic connecting element. The loop antenna, the dipole antenna and the connecting element are all formed on a substrate, for example, they are printed on a printed circuit board.

It is will also be seen below that one end of the loop antenna is connected to an SMA (SubMiniature version A) connector. In some wireless communication devices, the folded dipole antenna is connected to a microwave circuit through a balun. The balun functions to transform a balanced signal to an unbalance signal, and vice versa. However, the balun results in increased utilization of PCB area. Further, as an RF switch needs to be used for transmission as well as for reception but this increases the PCB area occupied by the antenna.

Figure 1:
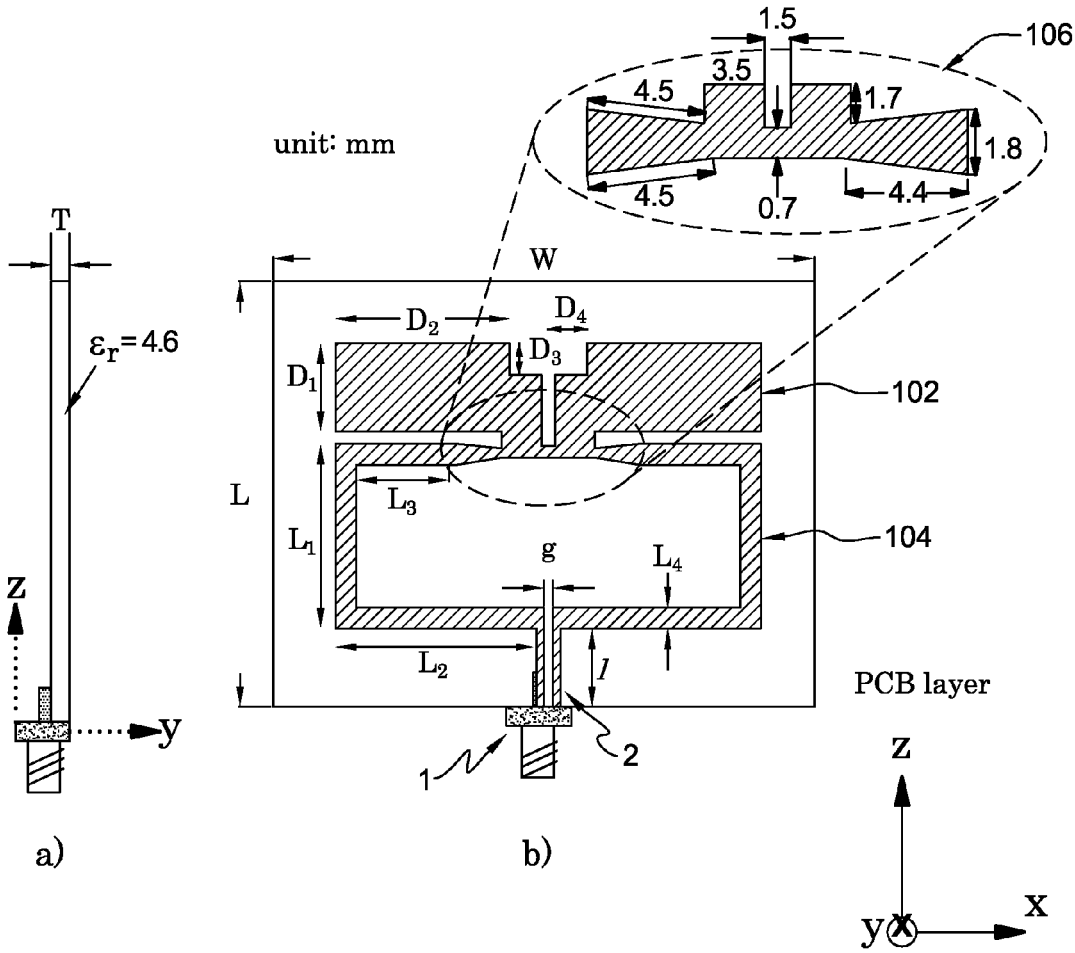
FIG. 1 is a schematic diagram illustrating a dipole and loop antenna on a printed circuit board, in accordance with one example of the present invention.

FIG. 1 is a schematic diagram illustrating an antenna composed of a dipole 102 and a loop antenna 104 is shown, in accordance with one example of the present invention. The dipole 102 is preferably a fat dipole so that it reduces the antenna size compared with a traditional half-wavelength dipole antenna. The loop antenna has a total length equal to one wavelength and is in a rectangular loop shape. A transition element 106 connects the dipole and loop antenna together and functions as a connecting element. One end of the loop antenna is connected to a SMA connector 1 and the other end of the loop is directly connected to the ground 2 of the connector. A co-planar strip line is used for a better matching.

As seen in the FIG. 1, the feed lines are realized by two parallel strips of line width 0.5 mm, length l=8.4 mm and separated by a gap of g=1.2 mm. The proposed balanced antenna has been measured using an unbalanced feed line without a balun. There will be some distortion on both radiation pattern and impedance matching measurements from the induced currents on the outside of the coaxial shield. The results can be improved by using the balun which transform the balanced signal to an unbalance signal, and vice versa; nevertheless, the drawbacks of balun are that it causes the antenna to be larger in size and cost ineffective in cost for some applications.

In various examples of the present invention, the rectangular loop antenna 104 may be a square shape or a circular loop. The antenna performance is the same for equal wavelength. The dipole 102 may use a half wavelength dipole along the Z-axis. All of the antenna element may be formed using a radiating material such as copper or aluminum formed on a printed circuit board.

Table I below shows the values of the various dimensions labeled in FIG. 1 in mm for an antenna designed for transmission/reception at 2.4 GHz.

TABLE I

| | Parameters | | | |
|---|---|---|---|---|
| | L | W | $L_1$ | $L_2$ |
| Values, mm | 51 | 41 | 17.1 | 18.2 |
| | Parameters | | | |
| | $L_3$ | $L_4$ | $D_1$ | $D_2$ |
| Values, mm | 8.8 | 1.8 | 8.2 | 15.7 |
| | Parameters | | | |
| | $D_3$ | $D_4$ | g | l | T |
| Values, mm | 3 | 2.8 | 1.2 | 8.4 | 1.6 |

It will of course be understood that the dimensions of the parameters would vary with wavelength and therefore Table II below shows the same parameters as approximate wavelength fractions.

TABLE II

| | Parameters | | | |
|---|---|---|---|---|
| | L | W | $L_1$ | $L_2$ |
| Values, λ | 0.41 | 0.33 | 0.14 | 0.15 |
| | Parameters | | | |
| | $L_3$ | $L_4$ | $D_1$ | $D_2$ |
| Values, λ | 0.07 | 0.015 | 0.066 | 0.125 |
| | Parameters | | | |
| | $D_3$ | $D_4$ | g | l | T |
| Values, λ | 0.025 | 0.022 | 0.01 | 0.067 | 0.013 |

Figure 2:
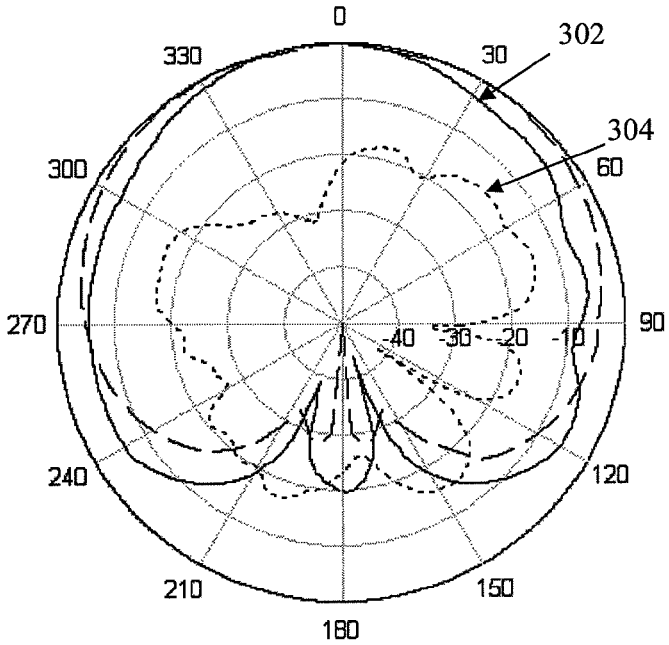
FIG. 2*a* is a radiation pattern illustrating the vertical and horizontal polarization of a dipole antenna, in vertical configuration, in accordance with another example of the present invention.
FIG. 2*b* is a radiation pattern illustrating the vertical and horizontal polarization of a dipole antenna, in horizontal configuration, in accordance with another example of the present invention.
Figure 2:
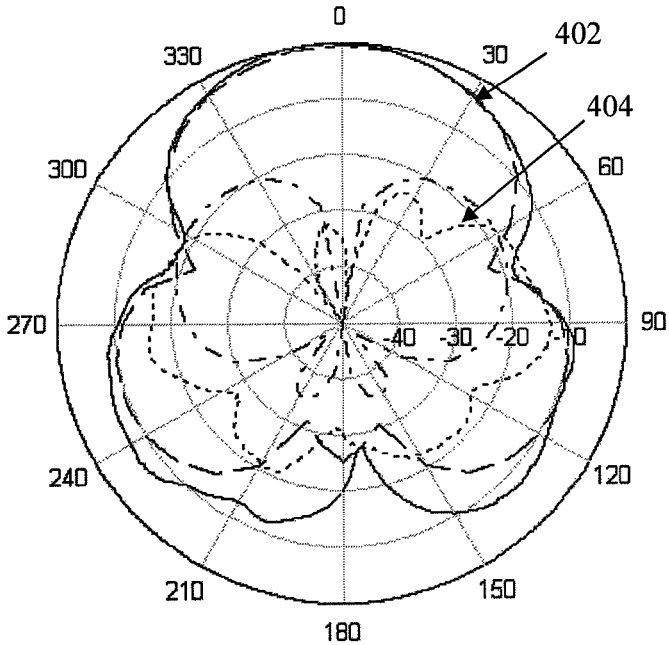

Referring now to FIG. 2*a*, a radiation pattern illustrating the vertical and horizontal polarization of the loop and dipole antenna, in vertical configuration, is shown for an antenna in accordance with an example of the present invention. Radiation pattern 302 illustrates vertical polarization of the proposed antenna in vertical configuration, while radiation 304 illustrates horizontal polarization of the antenna in vertical configuration. Both the radiation patterns, 302 and 304, were measured at a radiating frequency of 2.4 GHz. FIG. 2*a* shows that the antenna, in vertical configuration, has a dominant front to back ratio of 20 dB along the z-axis, which fulfills the unidirectional antenna requirement.

Referring now to FIG. 2*b*, a radiation pattern illustrating the vertical and horizontal polarization of the loop and dipole antenna, in horizontal configuration, is shown for an antenna in accordance with an embodiment of the present invention. Radiation pattern 402 illustrates vertical polarization of the proposed antenna in vertical configuration, while radiation 404 illustrates horizontal polarization of the antenna in vertical configuration. Both the radiation patterns, 402 and 404, were measured at a radiating frequency of 2.4 GHz. FIGS. 2*a* and 2*b* show that the antenna, in horizontal configuration, has a dominant propagation wave front in a direction along its Z-axis.

Figure 3:
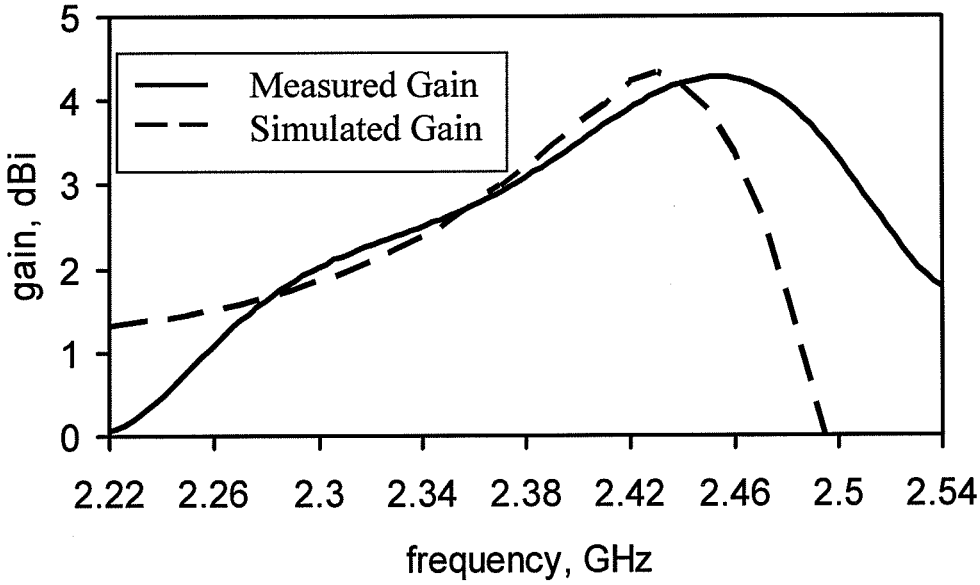
FIG. 3 is a graph illustrating the gain of the antenna of FIG. 1.

FIG. 3 illustrates the measured gain of the antenna in the frequency range of 2.22 GHz to 2.54 GHz. The peak measured gain is 4.2 dbi at 2.44 GHz.

In the present invention, the antenna is a good candidate for applications that require a small device that has a directional radiation pattern, for example in-home wireless audio for transmission between the speakers and the transceiver, and some handheld devices that require radiation in a particular direction. By using the present antenna, the radiating element radiates a unidirectional radiation pattern which increases the direct power transfer efficiency.

While the above examples of the present invention have been illustrated and described, it will be clear that the present invention is not limited to these examples only. Numerous modifications, changes, variations and equivalents will be apparent to those skilled in the art, without departing from the spirit and scope of the present invention, as described in the claims.

The invention claimed is:

1. A unidirectional antenna for at least one of transmitting and receiving radio frequency waves, the unidirectional antenna comprising a dipole antenna element and a loop antenna element coupled by a metallic transition element, wherein the loop antenna element is arranged to have a total length of substantially one wavelength of the radio frequency waves, thereby forming an integrated antenna arranged to generate a common radiation pattern having a dominant propagation wave front along one axis, wherein the metallic transition element is arranged to join a first portion of the dipole antenna element and a second portion of the dipole antenna element to define a first and second junction adjacent to a center top portion of the loop antenna element with a width of the metallic transition element being less than the width of the loop antenna element, and wherein the dipole antenna element, loop antenna element and metallic transition element are formed on a substrate.

2. The antenna of claim 1, wherein the unidirectional antenna generates a unidirectional radiation pattern with front-to-back ratio of 20 dB.

3. The antenna of claim 1, wherein the dipole antenna element is a fat dipole.

4. The antenna of claim 1, wherein the loop antenna element is a rectangular loop antenna.

5. The antenna of claim 1, wherein the loop antenna element has a shape that is one of circular and square.

6. The antenna of claim 1, wherein no ground plane is provided.

7. The antenna of claim 1, wherein the substrate comprises a printed circuit board.

8. The antenna of claim 1, wherein one end of the loop antenna element is connected to a SubMiniature version A (SMA) connector and the other end of the loop antenna is connected to ground.

9. The antenna of claim 1, wherein the unidirectional antenna is fed without a balun.

10. The unidirectional antenna of claim 1, wherein the dipole antenna element is fed via the loop antenna element.

11. The unidirectional antenna of claim 1, wherein the first and second junctions are next to each other.

12. A unidirectional antenna for at least one of transmitting and receiving radio frequency waves, the unidirectional antenna comprising a dipole antenna element and a loop antenna element connected by a metallic transition element, wherein the loop antenna element is arranged to have a total length of substantially one wavelength of the radio frequency waves, thereby forming an integrated antenna arranged to generate a common radiation pattern having a dominant propagation wave front along one axis, wherein the metallic transition element is arranged to join a first portion of the dipole antenna element and a second portion of the dipole antenna element to define a first and second junction adjacent to a center top portion of the loop antenna element with a width of the metallic transition element being less than the width of the loop antenna element, and wherein the dipole antenna element, loop antenna element and metallic transition element are formed on a substrate.

13. The unidirectional antenna of claim 12, wherein the dipole antenna element is fed via the loop antenna element.

* * * * *